US006457385B1

(12) United States Patent
Hu

(10) Patent No.: US 6,457,385 B1
(45) Date of Patent: Oct. 1, 2002

(54) PRECISION DRIVER ROTATION STRUCTURE

(76) Inventor: Cheng-tsan Hu, No. 205, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 0 days.

(21) Appl. No.: 09/946,354

(22) Filed: Sep. 6, 2001

(30) Foreign Application Priority Data

Aug. 20, 2001 (TW) ..... 90214159 U

(51) Int. Cl.[7] ..... B25B 17/00
(52) U.S. Cl. ..... 81/57.3; 81/57.14
(58) Field of Search ..... 81/57.3, 57.31, 81/57.14, 59.1, 52

(56) References Cited

U.S. PATENT DOCUMENTS 4,048,874 A * 9/1977 Riches ..... 81/57.31
4,828,049 A * 5/1989 Preis ..... 173/163
4,846,027 A * 7/1989 Lu ..... 81/57.3
5,009,132 A * 4/1991 Gilberto ..... 81/57.3
5,033,336 A * 7/1991 Chia-Tsai ..... 81/54
5,176,047 A * 1/1993 Bai et al. ..... 81/57.3
5,406,866 A * 4/1995 Badiali ..... 81/57.3
5,924,339 A * 7/1999 Huang ..... 81/57.31
5,947,212 A * 9/1999 Huang ..... 173/216
6,012,359 A * 1/2000 Lin ..... 81/57.31

* cited by examiner

*Primary Examiner*—Joseph J. Hail, III
*Assistant Examiner*—David B Thomas
(74) *Attorney, Agent, or Firm*—Rosenberg, Klein & Lee

(57) ABSTRACT

A rotation structure for a precision driver includes a handle, a bushing, a shank, a rotation plate, a knob and planet gears. The handle is a hollow tube provided at its top a containing base having meshing gear on its inner wall, and a bushing being plugged to the lower end of the tube. A blade is formed at the lower tip of the shank. An axial block integrated with a gear is connected to the upper end of the shank. A rotation plate containing axial holes is engaged with the axial block. The knob is pivoted to the top of the containing base. The planet gears are placed into between the gear and the meshing gear with the axis of each said planet gear penetrating through the corresponding axial hole provided in the rotation plate. An axial hole containing a rolling ball is provided in the center of the knob to permit the penetration by the upper end of the shank.

3 Claims, 4 Drawing Sheets

PRECISION DRIVER ROTATION STRUCTURE

BACKGROUND OF THE INVENTION (a) Field of the Invention

The present invention relates to a precision driver rotation structure, and more particularly, to a driver incorporated with a differential gear mechanism for easier and steady rotation.

(b) Description of the Prior Art:

Screwdrivers generally available in the market come highly diversified either in type or size. Force applied varies depending on the size of the screwdriver. For easier operation, ratchet is incorporated in the screwdriver used to set the driver for counter-clockwise or clockwise rotation or in both directions. However, a precision driver dedicated for minute screws needs only minimum force to be applied. In addition, the structure of the driver tends to be compact, leaving not much space to accommodate comparatively complicate clockwise or counter-clockwise ratchet mechanism while such ratchet mechanism is not necessarily required for the precision driver. Therefore, most of the precision drivers relate to a shank having one end fixed with a blade and the other end pivoted with a bonnet. In use, only one hand of the user is sufficient to tighten or loosen up a screw. The user has his/her index finger pressing against the bonnet and with other fingers of the same hand holding the shank to point the blade tip in the head of the screw to rotate the shank using the bonnet as a support axis.

However, said precision driver operates by directly rotating the shank to screw or unscrew with the blade. The driving itself is vulnerable to shaking and it is difficult for the blade to stick to the head of the screw while the rotation by the thumb in conjunction with the other three fingers may become very awkward. Therefore, the operation of the prior art of the precision driver is not so handy and further improvement is justified.

SUMMARY OF THE INVENTION

The primary purpose of the present invention is to provide a precision driver rotation structure. It is essentially composed of a knob on top of the driver, a differential gear mechanism below for transmitting the torque from the knob to driver a shank rotating in the same direction and a handle cladding the shaft to secure a firm grip of the driver.

To achieve the purpose, said handle relates to a hollow tube having at its top provided with a containing base, a circular space of accommodation is formed inside the containing base, and the inner wall of said containing base is provided with meshing gears, the lower end of the tube has a bushing. A blade is formed at the tip of the shank which penetrates the handle and the bushing. An axial block formed in one piece with a gear is provided at the upper shank with the shank penetrating through said axial block and gear. A rotation plate having multiple axial holes is pivoted and holding against the gradation of the axial block and the gear. A pivoting knob is mounted to the upper opening of the containing base having below it pivoted at equal distance at least three planet gears. The planet gears are located at where between the gear and the meshing gear on the inner wall of the containing base and placed into said meshing gear while each axis of said planet gears penetrates through the axial hole of said rotation plate. An axial hole containing a rolling ball is provided in the center at the base of the knob to receive the insertion of the upper shank that protruding from the gear; consequently, when the handle is held with the tip of the blade pressing a screw to rotate the head of the screw, said planet gears rotate against and voluntarily rotate surround the meshing gear on the inner wall of the containing base in opposite direction, thus rotating in the same direction as that of the knob but at slower speed to tighten up or loosen up the screw as desired.

DETAILED DESCRIPTION OF THE PREFERRED EMBODIMENTS

Figure 1:
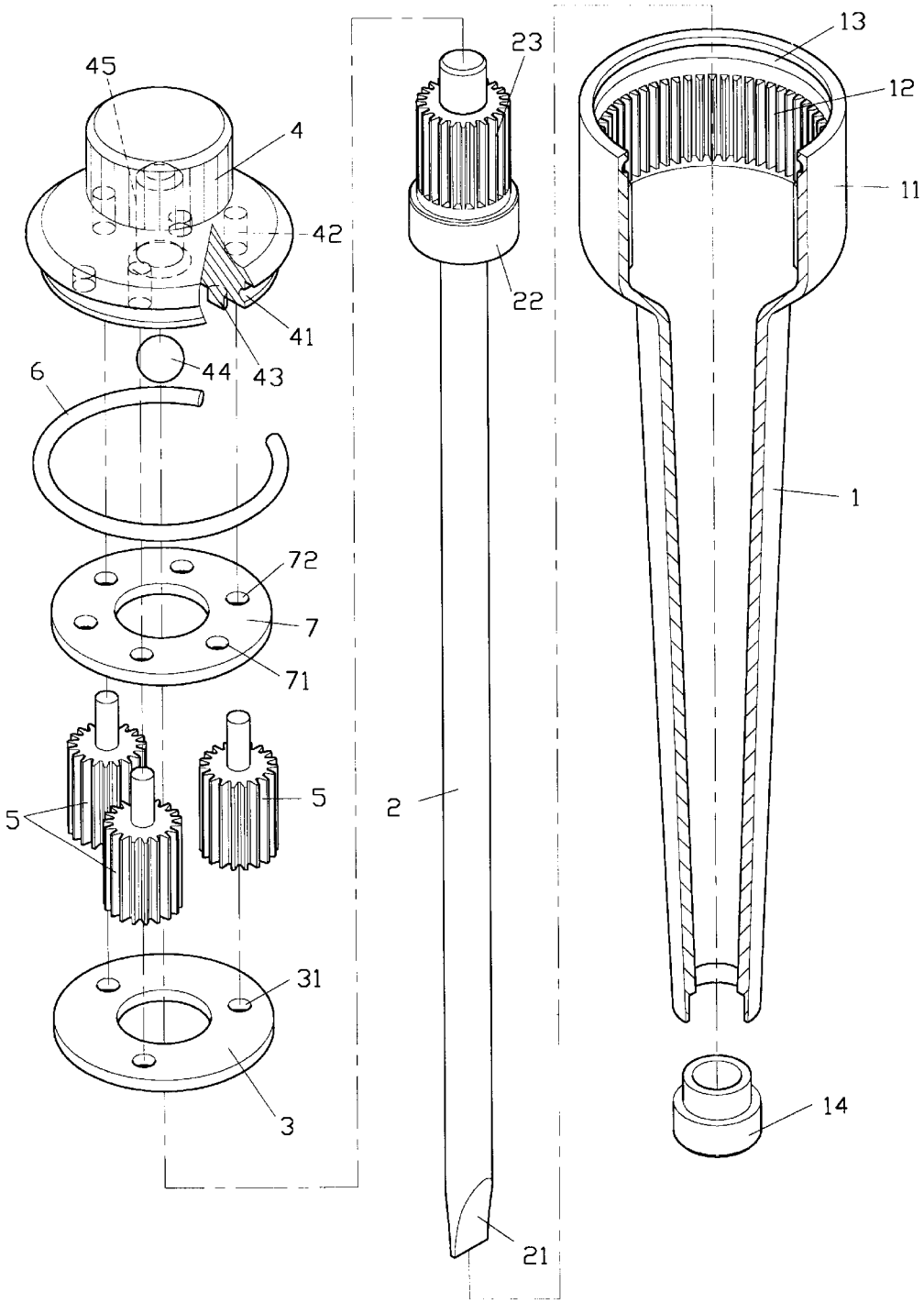
FIG. 1 is an exploded view showing a structure of a preferred embodiment of the present invention.

Referring to FIG. 1, a precision screwdriver of the present invention is essentially composed of a handle (1), a shank (2), a rotation plate (3), a knob (4) and multiples of planet gear (5).

The handle (1) relates to a hollow tube, a containing base (11) is formed at the top end of the shank (2) and meshing gear (12) is formed on the inner wall of the containing base (11). A groove (13) is formed on the inner at the top of the containing base (11) to allow insertion of a lock ring (6), and a bushing (14) is plugged into the lower end of the tube.

The shank (2) being inserted through the handle (1) has its tail protruding from the handle (1) and the bushing (14) formed with a blade (21) and its top connected with an axial block (22) linked to a gear (23) with the shank (2) penetrating through the gear (23). The rotation plate (3) is pivoted and holding against the gradation of the gear (23) and the axial block (22). Multiples of holes (31) are provided in the rotation plate (3). The gear (23) is placed into the meshing gear (12) of the containing base (11) at the same height.

The knob (4) with a base is pivoted at the top of the opening end of the containing base (11) of the handle (1). A groove (41) is formed in the circumference of the base of the knob (4) at where corresponds to the containing base (11) and is restricted by the lock ring (6). Inside the base of the knob (4), multiples of axial holes (42) and fixation rods (43) are provided at equal spacing among one another. The knob (4) is fixed to a retaining plate (7) by having the multiples of fixation rods (43) to penetrate multiples of holes (71) in the retaining plate (7) and then riveted. Multiple of axial holes (72) corresponding to those axial holes (42) in the knob (4) are provided in the retaining ring (7). The axial holes (72, 42) are used to pivot the planet gears (5) through their axes. The planet gears (5) are placed into where between the gear (23) and the meshing gear (12) on the inner wall of the containing base (11) while the lower axis of each the planet gear (5) penetrates through its corresponding axial hole (31) in the rotation plate (3). A central hole (45) containing a rolling ball (44) is provided in the center of the knob (4) for the upper end of the shank (2) passing through the gear (23) to hold against the ball (44), thus to form a differential gearing mechanism.

Figure 2:
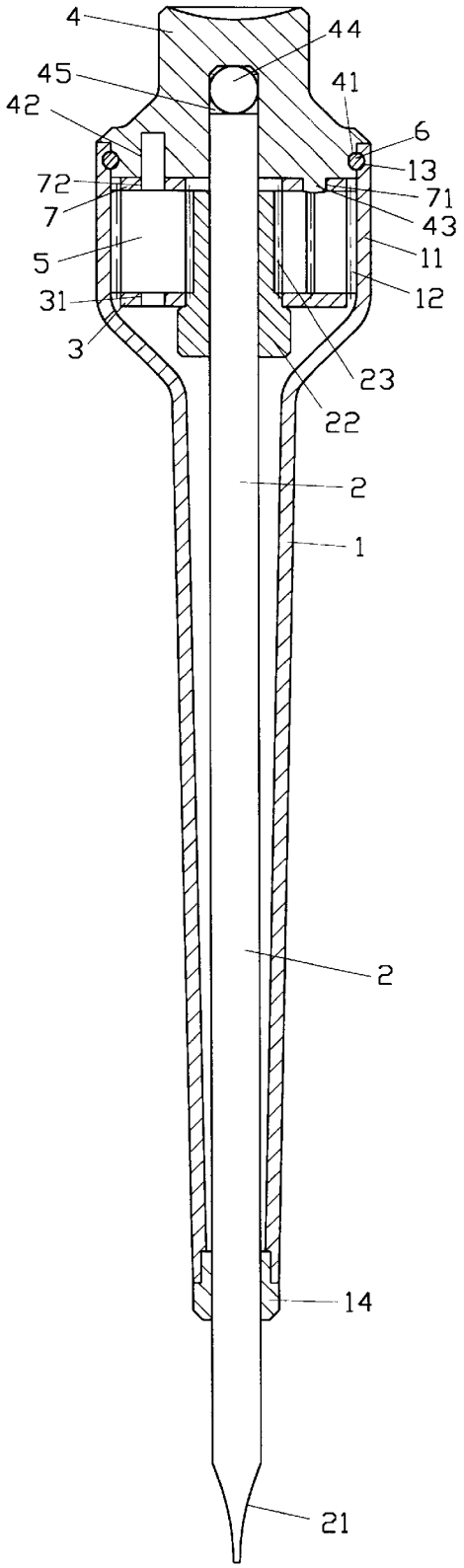
FIG. 2 is a cross-sectional view of an assembly of the preferred embodiment of the present invention.
Figure 3:
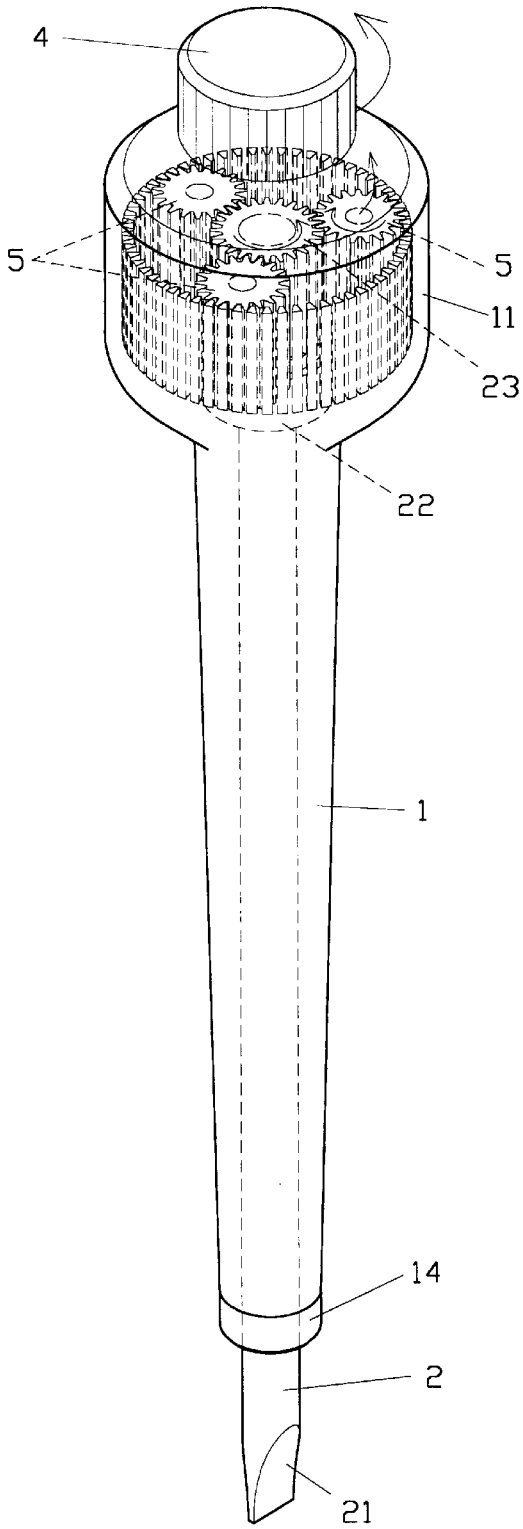
FIG. 3 is a view showing the operation of a rotation structure of the preferred embodiment of the present invention.
Figure 4:
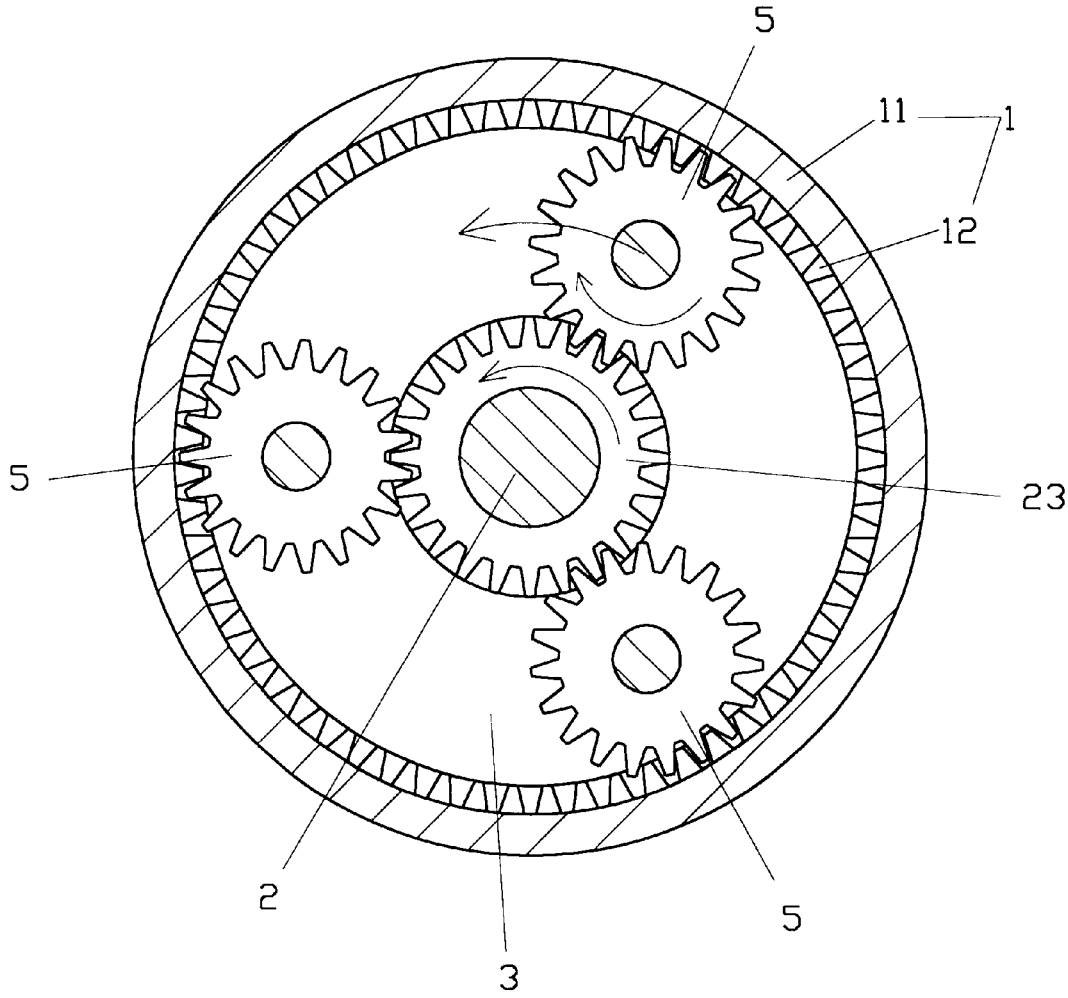
FIG. 4 is a cross-sectional view showing the operation of the rotation structure of the preferred embodiment of the present invention.

In use of a precision driver comprised of those members disclosed above, the handle (1) is gripped by the palm together with a middle finger, a ring finger and a little finger of one hand of a user to press the blade (21) of the shank (2) against the head of a screw. The upper end of the shank (2) is raised to hold against the rolling ball (44) in the central hole (45) of the knob (4) to form a central axial to support the pivoting of the shank (2). As illustrated in FIGS. 2 and 3, the knob (4) is turned (counter-clockwise in this case) at its top with a thumb and an index finger of the same hand. The three planet gears (5) pivoted to the base inside the knob (4) also revolve counter-clockwise. Each of the three planet gears (5) engages in voluntary rotation clockwise when placed into the meshing gear (12) on the inner wall of the containing base (11) to drive the gear (23) to rotate in the same direction as that of the turning knob (4), thus for the shank (2) to rotate in the same direction (counter-clockwise) at slower speed to drive the head of the screw.

As disclosed above, a rotation structure of the present invention for a precision driver is characterized by that a multiple of planet gears pivoted at the base in the knob and placed into the meshing gear on the inner wall of the containing base and the gear formed in one piece with the head of the shank of the driver establish a pattern, wherein, both of the shank and the differential gearing mechanism driving the shank are rotating in the same direction (clockwise or counter-clockwise); and that the handle containing the shank is designed for easy and firm grip by the user. The present invention in general providing easier and more convenient operation compared to the prior art.

What is claimed is:

1. A precision driver rotation structure comprising a handle, a bushing, a shank, a rotation plate, a knob, and multiples of planet gears, wherein, said handle being a hollow tube with a containing base formed at its top of said tube; said containing base formed an accommodation space having its inner wall provided with a meshing gear; and a bushing plugged to the lower end of said tube;

said shank inserting through said handle and having formed a blade at its lower tip, at its top connected to an axial block integrated with a gear, said shank penetrating through said gear and being pivoted and restricted at gradation between said gear and said axial block with said rotation plate, multiples of axial holes being provided on said rotation plate;

said knob being pivoted at the top of an opening end of said containing base of said handle, at least three planet gears being fixed in position at equal spacing on a base of said knob, said planet gears being placed into where between said gear and said meshing gear, each said planet gear with its axis penetrating through an axial hole provided in said rotation plate, a central axial hole containing a rolling ball being provided in the center of said knob to allow the upper end of said shank to penetrate through thus to form a differential gearing mechanism; and said handle when gripped and the tip of the blade pressing against the head of a screw, the upper end of said shank being raised to hold against said rolling ball in the central axial hole of said knob forming a central axis to support pivoting, said planet gears revolving and being placed into said meshing gear to rotate in the opposite direction to that of said knob, thus to drive said gear to rotate in the same direction as that of said knob for said shank to rotate in the same direction in driving the head of said screw.

2. A precision driver rotation structure as claimed in claim 1, wherein, abutted ends of said knob and said containing base are each provided with a groove and connected with a locking ring.

3. A precision driver rotation structure as claimed in claim 1, wherein, a retaining plate is fixed at the bottom inside the knob where said planet gears are pivoted, and a multiple of axial holes are provided on said retaining plate to permit penetration by axes of said planet gears.

* * * * *